US006326087B1

(12) United States Patent
Nishiuchi et al.

(10) Patent No.: US 6,326,087 B1
(45) Date of Patent: Dec. 4, 2001

(54) RARE EARTH METAL-BASED PERMANENT MAGNET, AND PROCESS FOR PRODUCING THE SAME

(75) Inventors: Takeshi Nishiuchi; Fumiaki Kikui, both of Osaka (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/461,006

(22) Filed: Dec. 15, 1999

(30) Foreign Application Priority Data

| | | |
|---|---|---|
| Dec. 17, 1998 | (JP) | 10-375728 |
| Feb. 26, 1999 | (JP) | 11-051934 |
| Apr. 14, 1999 | (JP) | 11-106027 |
| Jun. 28, 1999 | (JP) | 11-181357 |
| Nov. 29, 1999 | (JP) | 11-337841 |

(51) Int. Cl.[7] ..... H01F 1/00

(52) U.S. Cl. ..... 428/611; 428/469; 428/472; 428/472.2; 428/900

(58) Field of Search ..... 428/639, 469, 428/900, 611, 472, 472.2

(56) References Cited

U.S. PATENT DOCUMENTS 5,840,375 * 11/1998 Katsumi et al. ..... 427/600

OTHER PUBLICATIONS

Patent Abstracts of Japan, Abstract for JP 06019653, Publication No. 07230906, Aug. 29, 1995.

Patent Abstracts of Japan, Abstract for JP 60289314, Publication No. 62149108, Jul. 3, 1987.

Patent Abstracts of Japan, Abstract for JP 04353007, Publication No. 06176911, Jun. 24, 1994.

* cited by examiner

*Primary Examiner*—John Sheehan
*Assistant Examiner*—Andrew L. Oltmans
(74) *Attorney, Agent, or Firm*—Armstrong, Westerman, Hattori, McLeland & Naughton

(57) ABSTRACT

A rare earth metal-based permanent magnet has a metal oxide film formed on the surface thereof by a sol-gel coating process. The rare earth metal-based permanent magnet is produced by forming a metal oxide film on the surface thereof by a sol-gel coating process. The metal oxide film is thin and dense. The adhesion of the film to the surface of the magnet is excellent. The film exhibits an excellent corrosion resistance. Typical examples of the metal oxide films are Al, Si, Ti and Zr oxide films. An interfacial layer with an R (rare earth element) atom chemically bonded with a film forming metal atom through an oxygen atom is formed between the metal oxide film and the entire surface of the magnet.

10 Claims, 4 Drawing Sheets

——— INTERFACIAL LAYER

- - - - - - - - - INSIDE OF MAGNET

RARE EARTH METAL-BASED PERMANENT MAGNET, AND PROCESS FOR PRODUCING THE SAME

BACKGROUND OF THE INVENTION

1. Field of the Invention

The present invention relates to a rare earth metal-based permanent magnet having a thin and dense metal oxide film which exhibits an excellent corrosion resistance and which is formed on a surface thereof with an excellent adhesion, and a process for producing the same at a low cost and with little effect on the environment.

2. Description of the Related Art

A rare earth metal-based permanent magnet such as an R—Fe—B based permanent magnet represented by a Nd—Fe—B based permanent magnet and an R—Fe—N based permanent magnet represented by a Sm—Fe—N based permanent magnet is made of a material rich in resource and inexpensive, and has a high magnetic characteristic, as compared with a Sm—Co based permanent magnet. Therefore, particularly the R—Fe—B based permanent magnet is used at present in a variety of fields.

However, the rare earth metal-based permanent magnet contains R which is liable to be oxidized and corroded in the atmosphere. Therefore, when the rare earth metal-based permanent magnet is used without being subjected to any surface treatment, the corrosion advances from the surface due to the presence of a small amount of an acid, alkali or water to generate a rust, thereby bringing about the deterioration and dispersion of the magnetic characteristic. Further, if the rusted magnet is incorporated in a device such as a magnetic circuit, there is a possibility that the rust is scattered to pollute the surrounding parts or components.

There are various proposed processes for forming a metal oxide film as a corrosion resistant film on the surface of a magnet with the foregoing in view.

For example, Japanese Patent Application Laid-open No. 63-192216 describes a process for forming various metal oxide film by applying an Al compound, an Si compound or a Ti compound to the surface of a magnet and drying such compound.

Japanese Patent Publication No. 2-37081 describes a process for forming an Si oxide film by applying an Si-alcoholate to the surface of magnet and then heating and decomposing the Si-alcoholate.

Japanese Patent Applicaion Laid-open No. 63-301506 describes a process comprising applying a colloidal solution containing fine inorganic particles ($SiO_2$) and then heating and solidifying the solution.

Japanese Patent Applicaion Laid-open No. 63-168009 describes a process comprising depositing a Ti compound onto the surface of a magnet and then subjecting it to a heat treatment at 700° C. in an inert atmosphere.

In recent years, a reduction in size and down-sizing of parts have been advanced in electronic and appliance industries in which a rare earth metal-based permanent magnet is used. In correspondence to this, it is required that the magnet itself is reduced in size and cost. To meet this requirement, the surface treatment of the magnet must be carried out with higher dimensional accuracy (a reduction in thickness of a film and an excellent corrosion resistance in a thin film), with an increase in effective volume and at a low cost. Further, consideration of the environment is indispensable at present, and the influences of a treating solution and the film itself on the environment should be taken into consideration.

In the conventionally proposed process, however, it is difficult to keep up with the recent situation.

More specifically, in the processes described in Japanese Patent Application Laid-open No. 63-192216 and Japanese Patent Publication No. 2-37081, a chemically unstable metal compound itself or a solution of such a chemically unstable metal compound merely diluted in a solvent is used. For this reason, the metal compound may be evaporated in the course of formation of a film, thereby producing pinholes in a formed metal oxide film. Such processes also suffer from a problem that metal compounds merely react with each other to form a film and hence, the adhesion between the film and the surface of a magnet is poor, and cracks are liable to be produced during cooling subsequent to the heating due to a difference in thermal expansion coefficient between the film and the surface of the magnet. Therefore, the corrosion resistance of the film is unstable and as a result, it is difficult to utilize such process for the formation of a thin film.

In the process described in Japanese Patent Application Laid-open No. 63-301506, the film formed of the fine inorganic particles is merely piled up on the surface of a magnet and hence, a dense film with no pinhole therein is not formed, and the adhesion of a formed film to the surface of a magnet is poor.

The process described in Japanese Patent Applicaion Laid-open No. 63-168009 has, in addition to the problems associated with the processes described in Japanese Patent Application Laid-open No. 63-192216 and Japanese Patent Publication No. 2-37081, problems that a heat treatment at a high temperature must be carried out and hence, there is a possibility that the deterioration of the magnetic characteristic of the magnet itself is brought about, and the producing equipment is large-sized, resulting in an increased cost, and that the process cannot be utilized for a bonded magnet which is not stable to heat.

SUMMARY OF THE INVENTION

Accordingly, it is an object of the present invention to provide a rare earth metal-based permanent magnet having a thin and dense metal oxide film exhibiting an excellent corrosion resistance and formed on a surface thereof with an excellent adhesion, and a process for producing the same at a low cost and with little effect on the environment.

The present inventors have made various studies with the foregoing in view and as a result, they have found that a metal oxide film formed on the surface of a magnet by a sol-gel coating process is dense with no pinhole and moreover, is excellent in adhesion to the surface of the magnet and hence, it has an excellent corrosion resistance even if its thickness is small, as compared with the conventional metal oxide film.

The present invention has been accomplished based on such knowledge. To achieve the above object, according to a first aspect and feature of the present invention, there is provided a rare earth metal-based permanent magnet having a metal oxide film formed on the surface thereof by a sol-gel coating process.

According to a second aspect and feature of the present invention, in addition to the first feature, the rare earth metal-based permanent magnet is an R—Fe—B based permanent magnet.

According to a third aspect and feature of the present invention, in addition to the first feature, the rare earth metal-based permanent magnet is an R—Fe—N based permanent magnet.

According to a fourth aspect and feature of the present invention, in addition to the first feature, the metal oxide film is formed from a metal oxide component including at least one member selected from Al, Si, Ti and Zr oxides.

According to a fifth aspect and feature of the present invention, in addition to the first feature, the metal oxide film is amorphous.

According to a sixth aspect and feature of the present invention, in addition to the first feature, the metal oxide film contains carbon (C).

According to a seventh aspect and feature of the present invention, in addition to the sixth feature, the content of carbon is in a range of 50 ppm to 1,000 ppm (wt/wt).

According to an eighth aspect and feature of the present invention, in addition to the first feature, the thickness of the metal oxide film is in a range of 0.01 $\mu$m to 5 $\mu$m.

According to a ninth aspect and feature of the present invention, there is provided a process for producing a rare earth metal-based permanent magnet, comprising the step of forming a metal oxide film on the surface of a magnet by a sol-gel coating process.

According to a tenth aspect and feature of the present invention, in addition to the ninth feature, the metal oxide film is formed from a metal oxide component including at least one member selected from Al, Si, Ti and Zr oxides.

According to an eleventh aspect and feature of the present invention, there is provided a rare earth metal-based permanent magnet having a metal oxide film, wherein the magnet has, between the metal oxide film and the entire surface of the magnet, an interfacial layer with an R (rare earth element) atom chemically bonded with a film forming metal atom through an oxygen atom.

According to a twelfth aspect and feature of the present invention, in addition to the eleventh feature, the metal oxide film is formed from a metal oxide component including at least one member selected from Al, Si and Ti oxides.

According to a thirteenth aspect and feature of the present invention, in addition to the eleventh feature, the interfacial layer is formed by forming the metal oxide film on the surface of the magnet by a sol-gel coating process.

According to a fourteenth aspect and feature of the present invention, there is provided a process for producing a rare earth metal-based permanent magnet, comprising the step of forming a metal oxide film on the surface of a magnet by a sol-gel coating process, thereby forming, between the metal oxide film and the entire surface of the magnet, an interfacial layer with an R (rare earth element) atom chemically bonded with a film forming metal atom through an oxygen atom.

According to a fifteenth aspect and feature of the present invention, in addition to the fourteenth feature, the metal oxide film is formed from a metal oxide component including at least one member selected from Al, Si and Ti oxides.

With the above features, the metal oxide film formed on the surface of the magnet is dense with no pinhole and moreover, is excellent in adhesion to the surface of the magnet. Therefore, the film has a sufficient corrosion resistance, even if it has a small thickness. Thus, it is possible to achieve a high dimensional accuracy and to provide an increase in effective volume of the magnet.

Among others, the rare earth metal-based permanent magnet having a metal oxide film formed on the surface thereof from a metal oxide component including Al oxide, Si oxide, Ti oxide and the like has, between the film and the entire surface of the magnet, an interfacial layer with an R atom chemically bonded with a metal oxide film forming metal atom through an oxygen atom. Therefore, the film has an extremely excellent adhesion to the surface of the magnet.

The rare earth metal-based permanent magnet having a metal oxide film formed on the surface thereof from a metal oxide component including the Zr oxide has an excellent corrosion resistance and an excellent alkali resistance.

With the above features, when the magnet is produced by forming the metal oxide film by the sol-gel coating process, the following effect can be provided: Most of a used sol solution is formed from an organic substance and hence, little water is used. Thus, the corrosion of the magnet during formation of the film can be prevented. The film is very thin and hence, the heat treatment step in the formation of the film is rapid, complete and hence the process is simple. Further, the film can be formed at a low temperature, leading to a reduced cost and a simple process and hence, only a small equipment investment is required. The film is formed from a metal or metals and oxygen, and a waste liquid can be easily treated, leading to an insignificant environmental problem.

The above and other objects, features and advantages of the invention will become apparent from the following description of the preferred embodiment taken in conjunction with the accompanying drawings.

DETAILED DESCRIPTION OF THE PRESENT INVENTION

Figure 1:
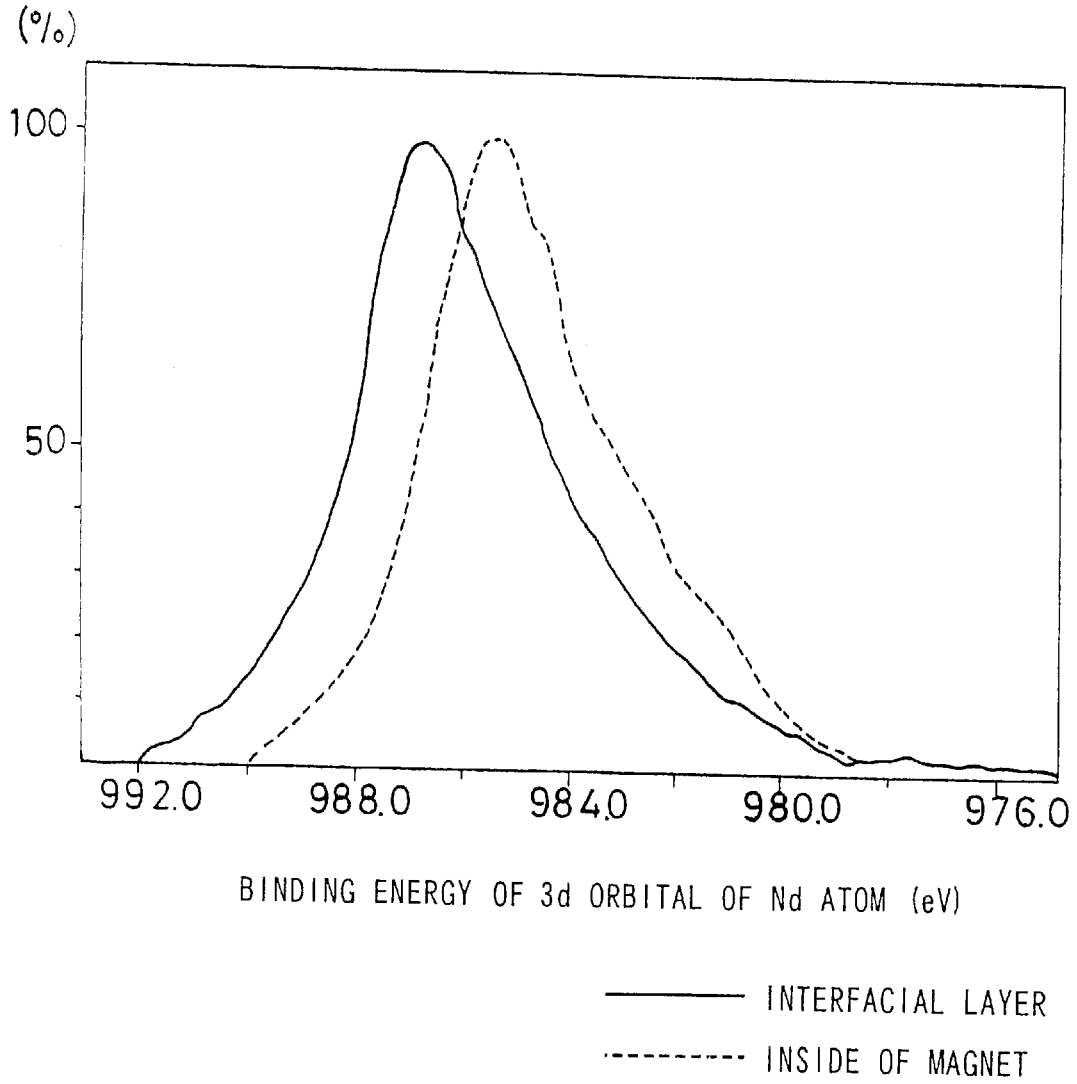
FIG. 1 is a diagram showing a result of an XPS measurement for the 3d orbital of Nd atom in a magnet having an aluminum (Al) oxide film and produced in Example 2.

A rare earth metal-based permanent magnet according to the present invention has a feature that a metal oxide film is formed on the surface of the magnet by a sol-gel coating process.

The metal oxide film formed on the surface of the magnet by the sol-gel coating process according to the present invention may be a metal oxide film formed from a single metal oxide component, or may be a metal composite oxide film formed from two or more metal oxide components.

Examples of the metal oxide film formed from the single metal oxide component are metal oxide films formed from Al, Si, Ti, Mg and Ca oxides, i.e., an Al oxide film (an $Al_2O_x$ film wherein $0<x\leqq3$), an Si oxide film (an $SiO_x$ film wherein $0<x\leqq2$), a Ti oxide film (a $TiO_x$ film wherein $0<x\leqq2$), an Mg oxide film (an $MgO_x$ film wherein $0<x\leqq1$), and a Ca oxide film (a $CaO_x$ film wherein $0<x\leqq1$). These metal oxide films are desirable in that each of them has an extremely excellent adhesion to the surface of the magnet. Among others, the Al oxide film, the Si oxide film and the Ti oxide film are desirable in that the sol solution prepared in forming the film by the sol-gel coating process is relatively stable. Especially, the sol solution for forming the Si oxide film is desirable in that it is extremely stable, as compared with the sol solutions for forming the other metal oxide films, and that it can be formed at a low temperature, as compared with the formation of the films formed from the other metal oxide components and hence, the influence on the magnetic characteristic of the magnet can be reduced.

The property of the metal oxide film that is extremely excellent adhesion to the surface of the magnet has been found by the present inventors as a result of repeated studies with their attention paid to the fact that the rare earth element (R) contained in the rare earth metal-based permanent magnet exhibits a strong reactivity to oxygen even at a relatively low temperature. More specifically, if the metal oxide film made of the Al oxide or the like is formed on the surface of the magnet by the sol-gel coating process, an R atom reacts with an oxygen atom derived from the metal compound as a film forming source or the like, so that the R atom is chemically bonded with the metal atom in the metal oxide film through the oxygen atom. The film formed by the sol-gel coating process is dense within pinhole therein and hence, the chemical bonding of the R atom with the metal atom in the metal oxide film through the oxygen atom occurs over the entire surface of the magnet. As a result, the interfacial layer with the R atom chemically bonded with the film forming metal atom through the oxygen atom is formed between the film and the entire surface of the magnet, leading to such a characteristic that the adhesion of the film to the surface of the magnet is excellent, and the peeling-off and the corrosion between the film and the magnet are not liable to occur. However, if pinholes exist, the interfacial layer is not formed in areas of the pinholes and hence, the adhesion around the pinholes is, of course, weaker and thus, the peeling-off and the corrosion advance from the pinholes. This characteristic can exist even when an oxide layer consisting essentially of R and/or Fe is present on the surface of the magnet, or when a nitride layer and/or an oxide layer is present on the R—Fe—N based permanent magnet, and an interfacial layer is formed on such a layer.

Another example of a film formed from a single metal oxide component is a film formed from a Zr oxide, i.e., a Zr oxide film (a $ZrO_x$ wherein $0<x\leqq 2$). The Zr oxide film is excellent in alkali resistance in addition to the corrosion resistance. Therefore, even when the magnet having the Zr oxide film is cleaned by an alkali-based detergent which is the subject of public attention, in place of a chlorine-based detergent which is not undesirable for the environment, there is not a possibility that the deterioration of the film and in its turn, the deterioration of the magnetic characteristic and rusting are caused.

In the case of the metal composite oxide film formed from two or more metal oxide components, it is desirable for the above-described reason that the film includes at least one selected from Al, Si, Ti and Zr oxides. More specifically, the film containing the Al, Si and/or Ti oxide is desirable in that it has an extremely excellent adhesion to the surface of the magnet, and that the sol solution for forming the film is relatively stable. A film containing the Zr oxide is desirable in that it is excellent in alkali resistance in addition to the corrosion resistance. Examples of such metal composite oxide films formed from two or more metal oxide components are an Si—Al composite oxide film (an $SiO_x.Al_2O_y$ film wherein $0<x\leqq 2$ and $0<y\leqq 3$), an Si—Ti composite oxide film (an $SiO_x.TiO_y$ film wherein $0<x\leqq 2$ and $0<y\leqq 2$), an Si—Zr composite oxide film (an $SiO_x.ZrO_y$ film wherein $0<x\leqq 2$ and $0<y\leqq 2$) and the like.

The formation of the metal oxide film on the surface of the magnet by the sol-gel coating process is achieved by applying, to the surface of the magnet, a sol solution produced by a hydrolytic reaction and/or a polymerizing reaction of a metal compound as a metal oxide film forming source, and then subjecting the magnet to a heat treatment.

The sol solution used may be a solution produced by mixing a metal compound as a metal oxide film forming source, a catalyst, a stabilizer, water and the like in an organic solvent, whereby a colloid produced by the hydrolytic reaction and/or the polymerizing reaction of the metal compound is dispersed in the solution.

The metal compounds as the metal oxide film forming sources, which may be used, include a metal alkoxide such as methoxide, ethoxide, propoxide, butoxide (including a metal alkoxide with at least one alkoxyl group substituted by an alkyl group such as methyl group and ethyl group or a phenyl group or the like); a carboxylate such as metal oxalate, acetate, octylate, stearate; a chelate compound such as metal acetylacetonate or the like; an inorganic salt such as metal nitrate and chloride. Such compounds may be used alone or in combination.

If the stability and cost of the sol solution are taken into consideration, for example, in the case of the Al compound used for forming the Al oxide film, it is desirable that an alkoxide having an alkoxyl group containing 3 to 4 carbon atoms such as Al propoxide or butoxide, or a carboxylate such as metal acetate or octylate is used. In the case of the Si compound used for forming the Si oxide film, it is desirable that an alkoxide having an alkoxyl group containing 1 to 3 carbon atoms such as Si methoxide, ethoxide and propoxide is used. In the case of the Ti compound used for forming the Ti oxide film, it is desirable that an alkoxide having an alkoxyl group containing 2 to 4 carbon atoms such as Ti ethoxide, propoxide and butoxide is used. In the case of the Zr compound used for forming the Zr oxide film, it is desirable that an alkoxide having an alkoxyl group containing 3 to 4 carbon atoms such as Zr propoxide and butoxide, or a carboxylate such as metal acetate and octylate is used.

When the metal composite oxide film is to be formed from the two or more metal oxide components, a plurality of metal compounds can be used in the form of a mixture of them. For example, when an Si—Zr composite oxide film is to be formed, an Si compound and a Zr compound may be used in the form of a mixture of them.

A metal composite compound such as a metal composite alkoxide can be used alone or in the form of a mixture with a metal compound. For example, when the Si—Al composite oxide film is to be formed, a Si—Al composite compound such as a Si—Al composite alkoxide having a Si—O—Al bond and having an alkoxyl group containing 1 to 4 carbon atoms (including a Si—Al composite alkoxide with at least one alkoxyl group substituted by an alkyl group such as methyl group and ethyl group or a phenyl group or the like), can be used. Particular examples of such compounds are $(H_3CO)_3$—Si—O—Al—$(OCH_3)_2$, $(H_5C_2O)_3$—Si—O—Al—$(OC_2H_5)_2$ and the like.

When a metal composite oxide film is to be formed using a plurality of metal compounds, the proportion of mixing of the metal compounds is particularly not limited. However, when a film is to be formed from at least one metal oxide component selected from Al, Si and Ti oxides and another metal oxide component, it is desirable that the metal compounds are mixed, so that the number of moles of at least one metal selected from Al, Si and Ti contained in the metal composite oxide film to the total number of moles of such at least one metal and another metal is 0.2 or more in terms of a molar ratio. For example, when a Si—Zr composite oxide film is to be formed, it is desirable that a Si compound and a Zr compound are mixed, so that the number of moles of Si to the total number of moles of Si and Zr contained in the Si—Zr composite oxide film (Si/Si+Zr) is 0.2 or more in terms of a molar ratio. Such mixing proportion ensures that an interfacial layer can be formed between the film and the surface of the magnet by Si atom in the film, thereby exhibiting an excellent adhesion, and the alkali resistance of the film can be enhanced by the Zr oxide component.

The proportion of incorporation of the metal compound into the sol solution is desirable to be in a range of 0.1 wt % to 20 wt % in terms of the metal oxide, for example, in terms of $SiO_2$ in the case of the Si compound, and in terms of $SiO_2$+$ZrO_2$ in the case of Si compound+Zr compound. However, if the proportion of incorporation is lower than 0.1 wt %, it maybe required that a forming step is conducted repeatedly a large number of times in order to produce a film having a sufficient thickness and for this reason, there is a possibility that the productivity is influenced. On the other hand, if the proportion of incorporation exceeds 20 wt %, the viscosity of the sol solution is increased and for this reason, there is a possibility that it is difficult to form a film.

Acids such as acetic acid, nitric acid, hydrochloric acid and the like may be used as a catalyst alone or in combination of two or more of them. The appropriate amount of acid added is defined by the hydrogen ion concentration of the sol solution prepared, and it is desirable that the acid is added, so that the pH value of the sol solution is in a range of 1 to 7. If the pH value is lower than 1 or exceeds 7, there is a possibility that the hydrolytic reaction and/or the polymerizing reaction for preparing a sol solution suitable for the formation of a film cannot be controlled.

The stabilizer used as required for stabilizing the sol solution is selected properly depending on the chemical stability of a metal compound used, but a desirable compound is a compound forming a chelate with a metal, such as β-diketone such as acetylacetone, and β-keto ester such as ethyl acetoacetate.

The amount of stabilizer incorporated is desirable to be 2 or less in molar ratio (stabilizer/metal compound), for example, when β-diketone is used. If the molar ratio exceeds 2, there is a possibility that the hydrolytic reaction and/or the polymerizing reaction for preparing the sol solution are impeded.

Water added to the sol solution may be supplied directly to the sol solution, or, water may be supplied indirectly using a chemical reaction. For example, when an alcohol is used as a solvent, water produced by the esterifying reaction of the alcohol with a carboxylic acid may be supplied to the sol solution. A method utilizing water vapor in the atmosphere may be also used. When water is supplied to the sol solution, the molar ratio of water/metal compound is desirable to be equal to or lower than 100. If the molar ratio exceeds 100, there is a possibility that the stability of the solution is influenced.

The organic solvent maybe one which is capable of homogeneously dissolving all of a metal compound, a catalyst, a stabilizer and water which are components for a sol solution, so that a produced colloid can be dispersed homogeneously in the sol solution. Particular examples are a lower alcohol represented by ethanol; a hydrocarbonic ether alcohol represented by ethylene glycol mono-alkyl ether; an acetate of a hydrocarbonic ether alcohol represented by ethylene glycol mono-alkyl ether acetate; an acetate of a lower alcohol represented by ethyl acetate; and a ketone represented by acetone. Among them, a lower alcohol such as ethanol, isopropyl alcohol and butanol is desirable to be used alone or in the form of a mixture from the viewpoints of the stability during a treatment and the cost.

The viscosity of the sol solution depends on the combination of the sol solution components, but is generally desirable to be lower than 20 cP. If the viscosity of the sol solution exceeds 20 cP, it is difficult to form a uniform film, and there is a possibility that cracks may be produced during the heat treatment.

The time and temperature for preparing the sol solution depend on the combination of various components contained in the sol solution. Usually, the preparing time is in a range of 1 minute to 72 hours, and the preparing temperature is in a range of 0° C. to 100° C.

If desired, fine inorganic particles (such as fine particles of Al, Si, Ti and Zr oxides and the like) may be dispersed in the sol solution.

Methods for applying the sol solution to the surface of the magnet, which may be used, include a dip coating process, a spraying process, a spin-coating process and the like.

After application of the sol solution to the surface of the magnet, the magnet is subjected to the heat treatment. The temperature for the heat treatment is a level sufficient to evaporate at least the organic solvent. For example, when ethanol is used as the organic solvent, a temperature of 80° C. which is a boiling point of ethanol is required. On the other hand, in a case of a sintered magnet, e.g., an Nd—Fe—B based sintered magnet, if the heat treatment temperature exceeds 450° C., there is a possibility that the deterioration of the magnetic characteristic of the magnet is brought about. Therefore, the heat treatment temperature is desirable to be in a range of 80° C. to450° C., but a temperature in a range of 80° C. to 250° C. is more desirable from the viewpoint that the generation of cracks during cooling subsequent to the heat treatment is prevented to the utmost. In a case of a bonded magnet, the temperature condition for the heat treatment must be set with the heat-resisting temperature of a used resin taken into consideration. For example, in a case of a bonded magnet produced using an epoxy resin and a polyamide resin, the heat treatment temperature is desirable to be in a range of 80° C. to 200° C. with the heat-resisting temperature of such resins taken into consideration. Usually, the heat treatment time is in a range of 1 minute to 1 hour.

The above-described process enables a metal oxide film essentially comprising an amorphous phase with an excellent corrosion resistance to be produced. For example, in a Si—Al composite oxide film, the structure thereof includes a large number of Si—O—Si bonds and a large number of Si—O—Al bonds in the case of a film rich in Si component, and a large number of Al—O—Al bonds and a large number of Si—O—Al bonds in the case of a film rich in Al component. The proportion of Al and Si components in the film is determined by the proportion of mixing of the above-described metal compounds.

The above-described process ensures that the formed metal oxide film contains carbon (C) attributable to the metal compounds and the stabilizer. The presence of carbon (C) ensures that a metal oxide film essentially comprising an amorphous phase with an excellent corrosion resistance can be produced easily, and the content of carbon is desirable to be in a range of 50 ppm to 1,000 ppm (wt/wt). If the content of C is lower than 50 ppm, cracks may be produced in some cases. On the other hand, if the content of C exceeds 1,000 ppm, there is a possibility that the densification of the film does not occur sufficiently.

In a rare earth metal-based permanent magnet having a metal oxide film formed on the surface thereof by the sol -gel coating process according to the present invention, the formed film itself is dense with no pinhole therein and moreover, the adhesion of the film to the surface of the magnet is excellent. Therefore, if the thickness of the film is equal to or larger than 0.01 μm, a sufficient corrosion resistance can be provided. The upper limit of the thickness of the film which can be produced according to the present invention is not limited, but the thickness suitable for practical use is equal to or smaller than 5 μm, desirably, 3 μm, based on the need for reduction in size of the magnet itself.

If required, the application of the sol solution to the surface of the magnet and the subsequent heat treatment may be, of course, conducted repeatedly a plurality of times.

When a metal oxide film made of at least one metal oxide component including Al, Si, Ti oxides and the like has been formed on the surface of the magnet, the presence of an interfacial layer with an R atom chemically bonded with a metal oxide film forming metal atom through an oxygen atom between the film and the surface of the magnet can be confirmed, for example, by an X-ray photoelectron spectrometer (XPS) or the like. In the interfacial layer, an R atom is chemically bonded with a metal oxide film forming metal atom through an oxygen atom and hence, the shift of binding energy (chemical shift) of the 3d orbital of the R atom is 0.5 eV or more toward a high energy side. Therefore, it is easy to discriminate between the presence and absence of the interfacial layer.

A further film may be formed on the metal oxide film according to the present invention. By employing such a configuration, the characteristic of the metal oxide film can be enhanced and improved, and a further function can be provided.

The rare earth element (R) used in the rare earth metal-based permanent magnet according to the present invention is desirable to be at least one element from among Nd, Pr, Dy, Ho, Tb and Sm, in addition thereto at least one element from among La, Ce, Gd, Er, Eu, Tm, Yb, Lu and Y.

Usually, one of the rare earth elements (R) suffices, but from the viewpoint of practical use, a mixture of two or more of rare earth elements (R) (such as misch metal and didymium and the like) may be used for the reason of availability.

If the content of R in the R—Fe—B based permanent magnet is lower than 10 at %, the crystal structure is the same cubic crystal structureas α-Fe and for this reason, a high magnetic characteristic, particularly, a high coercive force (HcJ) cannot be provided. On the other hand, if the content of R exceeds 30 at %, the content of a R-rich non-magnetic phase is increased, and the residual magnetic flux density (Br) is reduced and hence, a permanent magnet having an excellent characteristic cannot be produced. Therefore, it is desirable that the content of R is in a range of 10 at % to 30 at %.

If the content of Fe is lower than 65 at %, the residual magnetic flux density (Br) is reduced. If the content of Fe exceeds 80 at %, a high coercive force (HcJ) cannot be provided. Therefore, it is desirable that the content of Fe is in a range of 65 at % to 80 at %.

The temperature characteristic can be improved without deterioration of the magnetic characteristic of the produced magnet by substituting a portion of Fe by Co. However, if the content of Co substituting Fe exceeds 20 % of Fe, the magnetic characteristic is deteriorated and hence, such a content is undesirable. If the content of Co substituting Fe is in a range of 5 at % to 15 at %, the residual magnetic flux density (Br) is increased, as compared with a case where Fe is not substituted by Co, and hence, such a content is desirable for providing a high magnetic flux density.

If the content of B is lower than 2 at %, arhombohedral structure is a main phase and hence, a high coercive force (HcJ) cannot be provided. If the content of B exceeds 28 at %, the content of a B-rich non-magnetic phase is increased, and the residual magnetic flux density (Br) is reduced and hence, a permanent magnet having an excellent characteristic cannot be produced. Therefore, it is desirable that the content of B is in a range of 2 at % to 28 at %.

For the purpose of improving the productivity of the magnet and reducing the cost, at least one of 2.0 wt % or less of P and 2.0 wt % or less of S may be contained in a total amount of 2.0 wt % or less in the magnet. Further, the corrosion resistance of the magnet can be improved by substituting a portion of B by 30 wt % or less of C.

Furthermore, the addition of at least one of Al, Ti, V, Cr, Mn, Bi, Nb, Ta, Mo, W, Sb, Ge, Sn, Zr, Ni, Si, Zn, Hf and Ga is effective for improving the coercive force and the rectangularity of a demagnetization curve, and for improving the productivity of the magnet and for reducing the cost. To ensure that the maximum energy product (BH)max is equal to or larger than 159 kJ/m$^3$, the residual magnetic flux density (Br) of at least 0.9 T or more is required. Therefore, it is desirable that the amount of such at least one element added is in a range which meets such condition.

It should be noted that the R—Fe—B based permanent magnet may contain impurities inevitable for the industrial production thereof in addition to R, Fe and B.

Among the R—Fe—B based permanent magnets according to the present invention, a sintered magnet which comprises, as a main phase, a compound having a tetragonal crystal structure with the average grain size of crystals in a range of 1 μm to 80 μm, and further includes a non-magnetic phase in a content of 1 % to 50 % by volume, exhibits a high coercive force HcJ equal to or larger than 80 kA/m, a residual magnetic flux density Br larger than 0.4 T, and a maximum energy product (BH)max equal to or larger than 80 kJ/m$^3$. In this case, the maximum value of (BH)max reaches 199 kJ/m$^3$ or more.

Further, examples of R—Fe—B based permanent magnets other than those described above are an anisotropic R—Fe—B based bonded magnet as described in Japanese Patent Application Laid-open No. 9-92515, a Nd—Fe—B based nanocomposite magnet having a soft magnetic phase (e.g., α-Fe and $Fe_3B$) and a hard magnetic phase ($Nd_2Fe_{14}B$) as described in Japanese Patent Applicaion Laid-open No. 8-203714, abonded magnet produced using an isotropic Nd—Fe—B based magnet powder (e.g., MQP-B (a trade name) made by MQI Co.) made by a melt quenching process which is conventionally widely used, and the like. Any of these magnets is used after being formed into a predetermined shape using a binder such as an epoxy resin.

One example of an R—Fe—N based permanent magnet is a permanent magnet represented by $(Fe_{1-x}R_x)_{1-y}N_y$ (wherein $0.07 \leqq x \leqq 0.3$ and $0.001 \leqq x \leqq 0.2$) as described in Japanese Patent Publication No. 5-82041.

EXAMPLES

The following tests were carried out using a sintered magnet (which will be referred to as a magnet test piece hereinafter) which had a composition of 17Nd-1Pr-75Fe-7B and a size of 23 mm×10 mm×6 mm and which was produced by pulverizing a known cast ingot and then subjecting the pulverized material to pressing, sintering, heat treatment and surface working, for example, in a manner as described in U.S. Pat. No. 4,770,723. In the following tests, the thickness of a metal oxide film was measured by the observation of a broken face of the film using an electron microscope. The content of C in the metal oxide film was measured using a glow discharge mass spectrometer. The structure of the metal oxide film was analyzed using an X-ray diffractometer.

The following examples will be described as being applied to a sintered magnet, but the present invention is not limited to the application to the sintered magnet and is applicable to a bonded magnet.

Examples 1 to 3

A sol solution was prepared at a composition, a viscosity and a pH value shown in Table 2 froman Al compound, a catalyst, a stabilizer, an organic solvent and water shown in Table 1. The sol solution was applied at a pulling rate shown in Table 3 by a dip coating process to a magnet test piece having a surface cleaned by shot blasting and by degreasing using a solvent. And then, the magnet test piece was subjected to a heat treatment shown in Table 3 to form an Al oxide film on the surface of the magnet test piece.

The thickness of the formed Al oxide film ($Al_2O_x$ film wherein $0<x\leqq 3$) and the content of C in the film are shown in Table 4. The chemical shift of the 3d orbital of the Nd atom toward a high energy side determined by XPS is shown in Table 4, and the result of the XPS measurement of the magnet having the Al oxide film formed in Example 2 is shown in FIG. 1. The XPS measurement was carried out using ESCA-850 (made by Shimadzu Corporation) and using MgKα used as X-ray under a condition of a vacuum degree of $10^{-6}$ Pa or less, at an accelerating voltage of 8 kV and at a current of 30 mA and in a range of 976 eV to 992 eV. The chemical shift was determined from the position of a peak in a spectrum provided by conducting an Ar ion etching (with beam scanning) at an accelerating voltage of 2 kV and at a current of 20 mA, while rotating a sample, and then measuring a photoelectron spectrum of the 3d orbital of Nd atom in an interfacial layer and the magnet.

The structure of the formed Al oxide film was analyzed by an X-ray diffraction method from which it was found that the film was amorphous. The surface of the Al oxide film was observed (at a magnification of ×1,000) by an electron microscope from which it was found that the film was dense with no pinhole therein.

TABLE 1

| | Al compound | Catalyst | Stabilizer | Organic solvent |
|---|---|---|---|---|
| Example 1 | aluminum isopropoxide | nitric acid | acetyl-acetone | ethanol |
| Example 2 | aluminum butoxide | acetic acid | ethyl aceto-acetate | ethanol + IPA |
| Example 3 | aluminum butoxide | hydrochloric acid | not added | 2-methoxy-ethanol |

IPA: isopropyl alcohol

TABLE 2

| | Proportion of Al compound (wt % in terms of $Al_2O_3$) | Molar ratio: Catalyst/Al compound | Molar ratio: Stabilizer/Al compound | Molar ratio: Water/Al compound | Viscosity (cP) | PH |
|---|---|---|---|---|---|---|
| Example 1 | 8 | 0.001 | 1.5 | 3 | 3.6 | 3.1 |
| Example 2 | 5 | 2 | 1 | 1 | 2.4 | 3.9 |
| Example 3 | 1 | 0.005 | 0 | 0 (*) | 1.5 | 2.4 |

(*): utilizing of water vapor in the atmosphere

TABLE 3

| | Pulling rate (cm/min) | Heat treatment |
|---|---|---|
| Example 1 | 1 | 240° C. × 20 min |
| Example 2 | 3 | 200° C. × 30 min |
| Example 3 | 10 | 175° C. × 60 min |

TABLE 4

| | Thickness of film (μm) | Content of C in film (ppm) | Chemical shift of $Nd_{3d}$ (eV) |
|---|---|---|---|
| Example 1 | 0.3 | 150 | 1.2 |
| Example 2 | 0.5 | 220 | 1.4 |
| Example 3 | 0.8 | 340 | 1.1 |

The magnet having the Al oxide film formed thereon was subjected to a corrosion resistance acceleration test, in which it was left to stand for 250 hours under high-temperature/high humidity conditions of a temperature of 60° C. and a relative humidity of 90%. The magnetic characteristics before and after the test and the variation in the appearance after the test are shown in Table 5. In the magnet having the Al oxide film formed thereon, the film itself is dense with no pinhole therein. An interfacial layer with a Nd atom chemically bonded with an Al oxide film forming Al atom through an oxygen atom was formed between the film and the entire surface of the magnet and hence, the adhesion of the film to the surface of the magnet is excellent, and after the test, the film cannot be peeled off. Therefore, as apparent from Table 5, it was seen that both of the magnetic characteristic and the appearance had little deteriorated even under the above-described severe conditions, and a required corrosion resistance was satisfied sufficiently.

TABLE 5

| | Before corrosion resistance test | | | After corrosion resistance test | | | |
|---|---|---|---|---|---|---|---|
| | Br(T) | HcJ(kA/m) | (BH)max (kJ/m$^3$) | Br(T) | HcJ(kA/m) | (BH)max (kJ/m$^3$) | Appearance after test |
| Example 1 | 1.14 | 1322 | 243 | 1.13 | 1298 | 236 | not varied |
| Example 2 | 1.14 | 1314 | 242 | 1.11 | 1282 | 233 | not varied |
| Example 3 | 1.13 | 1322 | 242 | 1.12 | 1314 | 237 | not varied |
| Comp. Example 1 | 1.14 | 1314 | 242 | 1.07 | 1258 | 224 | locally rusted |
| Comp. Example 2 | 1.13 | 1330 | 243 | 1.05 | 1242 | 217 | entirely rusted |

Comp. Example = Comparative Example

Comparative Example 1

The surface of a magnet test piece was cleaned by shot blasting and by degreasing using a solvent and then, the magnet test piece was immersed into 4-acetyl-3-butenyloxyl-aluminum-di-i-propoxylate and left to stand for 2 hours at room temperature, whereby an Al oxide film having a thickness of 0.5 $\mu$m was formed on the surface of the magnet test piece. The surface of the formed Al oxide film was observed (at a magnification of ×1,000) by an electronmicroscope and as a result, a large number of pinholes having a diameter of several $\mu$m were observed.

The magnet having the Al oxide film formed thereon was subjected to a corrosion resistance acceleration test under the same conditions as in Examples 1 to 3. The results are shown in Table 5. From the results, it was seen that the magnet having the Al oxide film did not satisfy a required corrosion resistance with respect to the magnetic characteristic and the appearance.

Comparative Example 2

A magnet test piece was subjected to a corrosion resistance test under the same conditions as in Examples 1 to 3. The results are shown in Table 5. As a result, it was seen that the magnet test piece did not satisfy a required corrosion resistance with respect to the magnetic characteristic and the appearance.

Examples 4 to 6

A sol solution was prepared at a composition, a viscosity and a pH value shown in Table 7 from an Si compound, a catalyst, an organic solvent and water shown in Table 6. The sol solution was applied at a pulling rate shown in Table 8 by a dip coating process to a magnet test piece having a surface cleaned by shot blasting and by degreasing using a solvent. And then, the magnet test piece was subjected to a heat treatment shown in Table 8 to form an Si oxide film on the surface of the magnet test piece.

Figure 2:
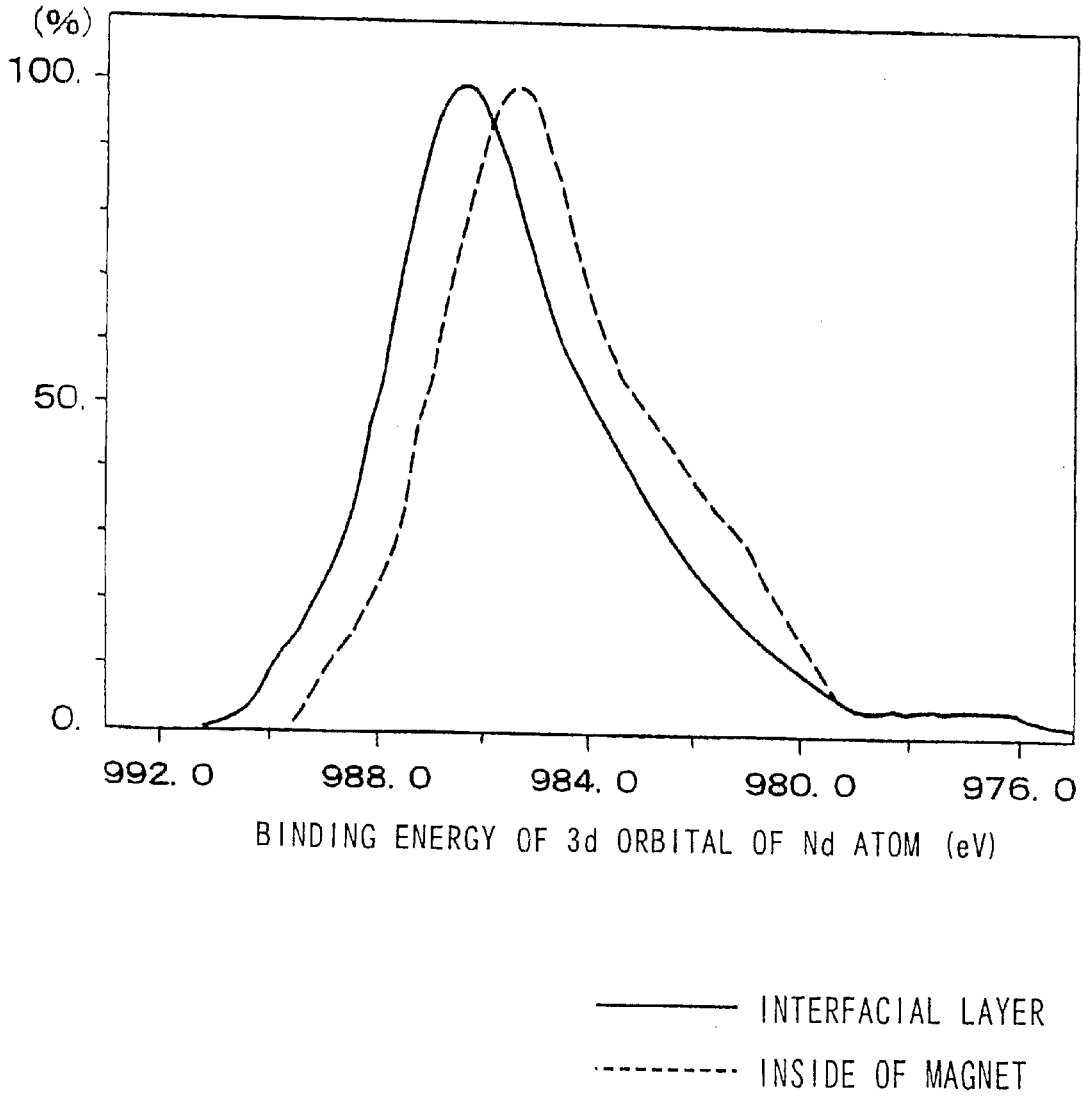
FIG. 2 is a diagram showing a result of an XPS measurement for the 3d orbital of Nd atom in a magnet having a silicon (Si) oxide film and produced in Example 6.
Figure 3:
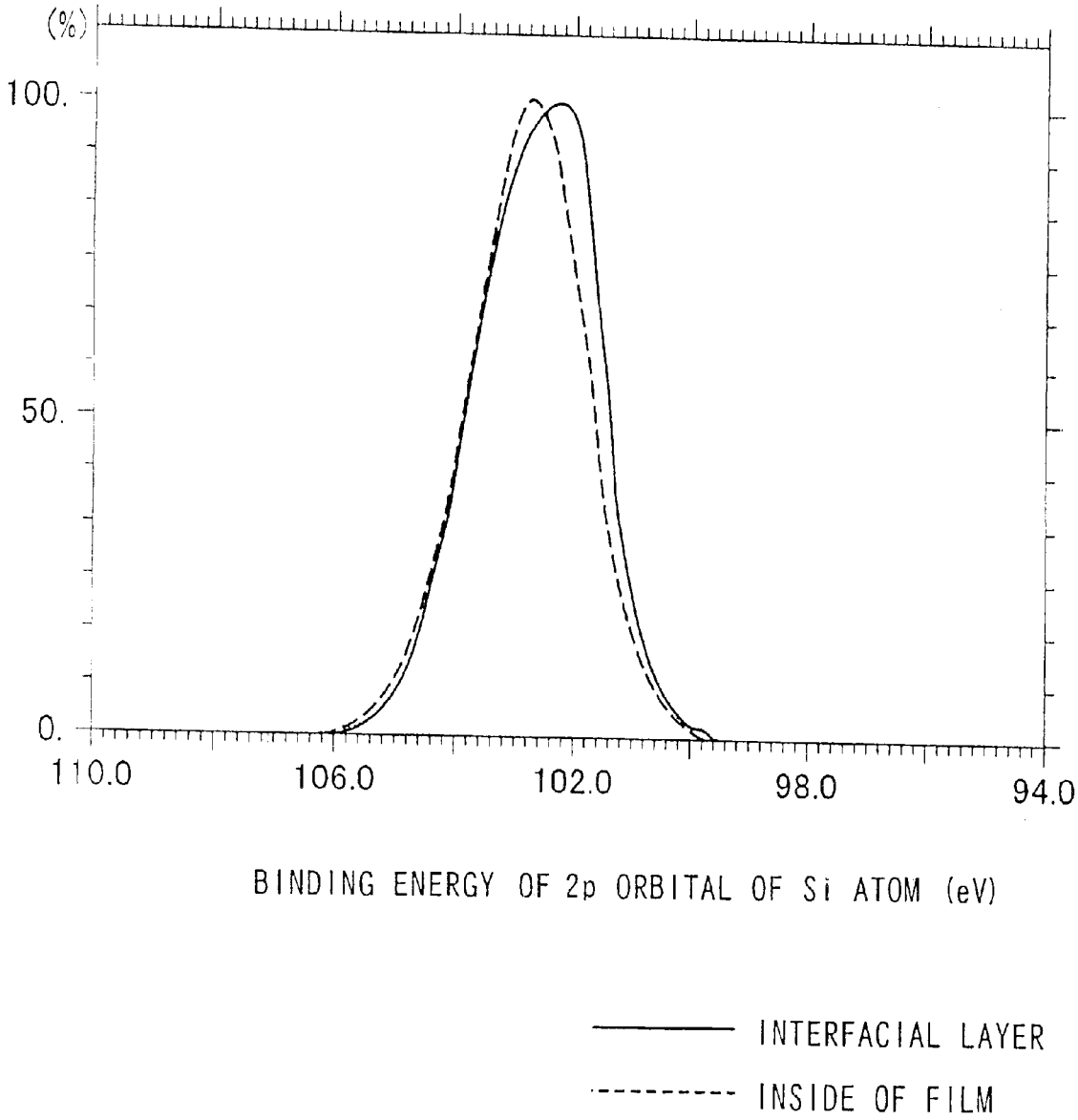
FIG. 3 is a diagram showing a result of an XPS measurement for the 2p orbital of Si atom in a magnet having a silicon (Si) oxide film and produced in Example 6.

The thickness of the formed Si oxide film ($SiO_x$ film wherein $0<x\leqq 2$) and the content of C in the film are shown in Table 9. The chemical shift of the 3d orbital of the Nd atom toward a high energy side determined by XPS is shown in Table 9, and the result of the XPS measurement of the magnet having the Si oxide film formed in Example 6 is shown in FIG. 2. The XPS measurement was carried out in the same manner as in Examples 1 to 3. The result of the XPS measurement of the 2p orbital of Si atom, which represents the fact that the magnet has an interfacial layer with Si atom in the Si oxide film chemically bonded with Nd atom through oxygen atom, is shown in FIG. 3. Its measurement was conducted in the same manner as the measurement of the 3d orbital of Nd atom, and the measuring range was of 94 eV to 110 eV.

The structure of the formed Si oxide film was analyzed by an X-ray diffraction method from which it was found that the film was amorphous. The surface of the Si oxide film was observed (at a magnification of×1,000) by an electron microscope from which it was found that the film was dense with no pinhole therein.

TABLE 6

| | Si compound | Catalyst | Organic solvent |
|---|---|---|---|
| Example 4 | tetramethoxy silane | hydrochloric acid | methanol |
| Example 5 | tetraethoxy silane | acetic acid | IPA |
| Example 6 | monomethyltriethoxy silane | nitric acid | ethanol |

IPA: isopropyl alcohol

TABLE 7

| | Proportion of Si compound (wt % in terms of $SiO_2$) | Molar ratio Catalyst/Si compound | Molar ratio Water/Si compound | Viscosity (cP) | pH |
|---|---|---|---|---|---|
| Example 4 | 5 | 0.001 | 3 | 1.4 | 3.2 |
| Example 5 | 1 | 2 | 2 | 1.3 | 4.1 |
| Example 6 | 10 | 0.005 | 10 | 1.7 | 2.2 |

TABLE 8

| | Pulling rate (cm/min) | Heat treatment |
|---|---|---|
| Example 4 | 7 | 150° C. × 20 min |
| Example 5 | 5 | 200° C. × 10 min |
| Example 6 | 10 | 100° C. × 20 min |

TABLE 9

| | Thickness of film (μm) | Content of C in film (ppm) | Chemical shift of $Nd_{3d}$ (eV) |
|---|---|---|---|
| Example 4 | 0.5 | 320 | 1.3 |
| Example 5 | 0.08 | 95 | 1.1 |
| Example 6 | 2 | 450 | 1.2 |

They magnet having the Si oxide film formed thereon was subjected to a corrosion resistance acceleration test under the same conditions as in Examples 1 to 3. The results are shown in Table 10. In the magnet having the Si oxide film formed thereon, the film itself is dense with no pinhole therein. An interfacial layer with a Nd atom chemically bonded with a Si oxide film forming Si atom through an oxygen atom was formed between the film and the entire surface of the magnet and hence, the adhesion of the film to the surface of the magnet is excellent, and after the test, the film cannot be peeled off. Therefore, as apparent from Table 10, it was seen that that both of the magnetic characteristic and the appearance had little deteriorated even under the above-described severe conditions, and a required corrosion resistance was achieved sufficiently.

TABLE 10

| | Before corrosion resistance test | | | After corrosion resistance test | | | |
|---|---|---|---|---|---|---|---|
| | Br(T) | HcJ(kA/m) | (BH)max (kJ/m³) | Br(T) | HcJ(kA/m) | (BH)max (kJ/m³) | Appearance after test |
| Example 4 | 1.14 | 1314 | 242 | 1.13 | 1306 | 237 | not varied |
| Example 5 | 1.14 | 1322 | 243 | 1.11 | 1290 | 234 | not varied |
| Example 6 | 1.13 | 1322 | 242 | 1.12 | 1314 | 238 | not varied |
| Comp. Example 3 | 1.14 | 1314 | 242 | 1.09 | 1266 | 226 | locally rusted |
| Comp. Example 4 | 1.13 | 1322 | 242 | 1.08 | 1258 | 225 | locally rusted |

Comp. Example = Comparative Example

Comparative Example 3

Tetraethoxy silane was applied in a spraying manner to a magnet test piece having a surface cleaned by shot blasting and by degreasing using a solvent, and was then heated for 20 minutes at 150° C., thereby forming an Si oxide film having a thickness of 0.5 μm on the surface of the magnet test piece. The surface of the formed Si oxide film was observed (at a magnification of ×1,000) by an electron microscope from which a large number of pinholes having a diameter of several μm were observed.

The magnet having the Si oxide film formed thereon was subjected to a corrosion resistance acceleration test under the same conditions as in Examples 1 to 3. The results are shown in Table 10. From the results, it was seen that the magnet having the Si oxide film did not satisfy a required corrosion resistance with respect to the magnetic characteristic and the appearance.

Comparative Example 4

A colloidal solution comprising 30 wt % of $SiO_2$, 35 wt % of pure water and 35 wt % of isopropyl alcohol was applied in a spraying manner to a magnet test piece having a surface cleaned by shot blasting and by degreasing using a solvent, and was then heated for 20 minutes at 160° C., thereby forming an Si oxide film having a thickness of 0.5 μm on the surface of the magnet test piece. The surface of the formed Si oxide film was observed (at a magnification of ×1,000) by an electron microscope from which a large number of pinholes having a diameter of several μm were observed.

The magnet having the Si oxide film formed thereon was subjected to a corrosion resistance acceleration test under the same conditions as in Examples 1 to 3. The results are shown in Table 10. As a result, it was seen that the magnet having the Si oxide film did not satisfy a required corrosion resistance with respect to the magnetic characteristic and the appearance.

Examples 7 and 8

A sol solution was prepared at a composition, a viscosity and a ph value shown in Table 12 from a Ti compound, a catalyst, a stabilizer, an organic solvent and water shown in Table 11. The sol solution was applied at a pulling rate shown in Table 13 by a dip coating process to a magnet test piece having a surface cleaned by shot blasting and by degreasing using a solvent. And then, the magnet test piece was subjected to a heat treatment shown in Table 13 to form a Ti oxide film on the surface of the magnet test piece.

Figure 4:
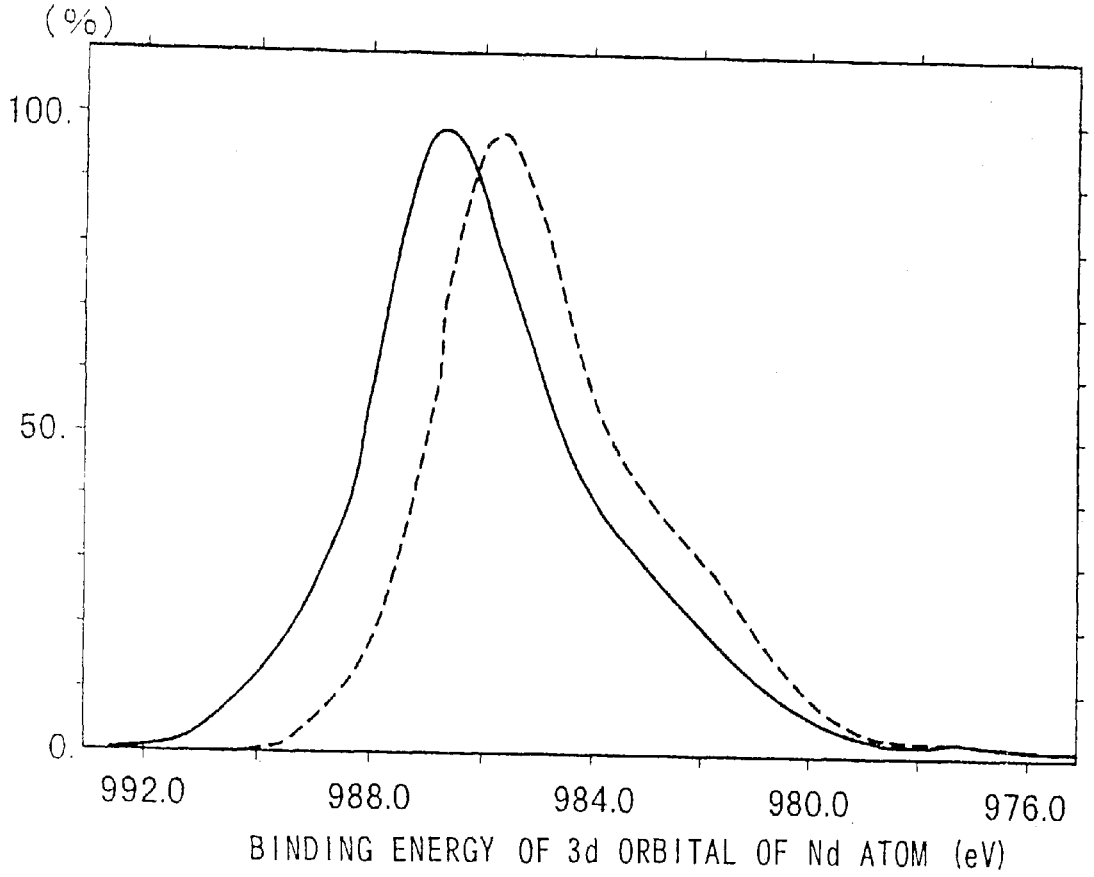
FIG. 4 is a diagram showing a result of an XPS measurement for the 3d orbital of Nd atom in a magnet having a titanium (Ti) oxide film and produced in Example 8.

The thickness of the formed Ti oxide film ($TiO_x$ film wherein $0<x\leqq 2$) and the content of C in the film are shown in Table 14. The chemical shift of the 3d orbital of the Nd atom toward a high energy side determined by XPS is shown in Table 14, and the result of the XPS measurement of the magnet having the Ti oxide film formed in Example 8 is shown in FIG. 4. The XPS measurement was carried out in the same manner as in Examples 1 to 3.

The structure of the formed Ti oxide film was analyzed by an X-ray diffraction method from which it was found that the film was amorphous. The surface of the Ti oxide film was observed (at a magnification of ×1,000) by an electron microscope from which it was found that the film was dense with no pinhole therein.

TABLE 11

| | Ti compound | Catalyst | Stabilizer | Organic solvent |
|---|---|---|---|---|
| Example 7 | titanium isopropoxide | nitric acid | not added | ethanol |
| Example 8 | titanium butoxide | hydrochloric acid | acetyl-acetone | ethanol + IPA |

IPA: isopropyl alcohol

TABLE 12

| | Proportion of Ti compound (wt % in terms of $Ti_2O_3$) | Molar ratio Catalyst/Ti compound | Stabilizer/ Ti compound | Water/Ti compound | Viscosity (cP) | PH |
|---|---|---|---|---|---|---|
| Example 7 | 3 | 0.002 | 0 | 1 | 2.2 | 2.1 |
| Example 8 | 5 | 0.005 | 1.5 | 3 | 1.7 | 2.6 |

TABLE 13

| | Pulling rate (cm/min) | Heat treatment |
|---|---|---|
| Example 7 | 3 | 240° C. × 20 min |
| Example 8 | 5 | 200° C. × 30 min |

TABLE 14

| | Thickness of film (μm) | Content of C in film (ppm) | Chemical shift of $Nd_{3d}$ (eV) |
|---|---|---|---|
| Example 7 | 0.4 | 230 | 1.2 |
| Example 8 | 0.7 | 390 | 1.0 |

The magnet having the Ti oxide film formed thereon was subjected to a corrosion resistance acceleration test under the same conditions as in Examples 1 to 3. The results are shown in Table 15. In the magnet having the Ti oxide film formed thereon, the film itself is dense with no pinhole therein. An interfacial layer with Nd atom chemically bonded with Ti oxide film forming Ti atom through oxygen atom was formed between the film and the entire surface of the magnet and hence, the adhesion of the film to the surface of the magnet is excellent, and after the test, the film cannot be peeled off. Therefore, as apparent from Table 15, it was seen that both of the magnetic characteristic and the appearance had little deteriorated even under the above-described severe conditions, and a required corrosion resistance was achieved sufficiently.

TABLE 15

| | Before corrosion resistance test Br(T) | HcJ(kA/m) | (BH)max ($kJ/m^3$) | After corrosion resistance test Br(T) | HcJ(kA/m) | (BH)max ($kJ/m^3$) | Appearance after test |
|---|---|---|---|---|---|---|---|
| Example 7 | 1.15 | 1322 | 244 | 1.13 | 1306 | 237 | not varied |
| Example 8 | 1.14 | 1314 | 242 | 1.11 | 1290 | 234 | not varied |
| Comp. Example 5 | 1.15 | 1306 | 242 | 1.07 | 1250 | 225 | locally rusted |

Comp. Example = Comparative Example

Comparative Example 5

The surface of a magnet test piece was cleaned by shot blasting and by degreasing using a solvent and then, the magnet test piece was immersed into a solution of di-i-propoxy-titanium-di-stearate (5 wt %) in hexane. The resulting magnet test piece was dried for 30 minutes at 60° C. in an atmosphere of nitrogen, whereby a Ti oxide film having a thickness of 0.5 μm was formed on the surface of the magnet test piece. The surface of the formed Ti oxide film was observed (at a magnification of ×1,000) by an electron microscope from which a large number of pinholes having a diameter of several μm were observed.

The magnet having the Ti oxide film formed thereon was subjected to a corrosion resistance acceleration test under the same conditions as in Examples 1 to 3. The results are shown in Table 15. From the results, it was seen that the magnet having the Ti oxide film did not satisfy a required corrosion resistance with respect to the magnetic characteristic and the appearance.

Example 9

A sol solution was prepared at a composition, a viscosity and a pH value shown in Table 17 from an Si compound, a Zr compound, a catalyst, a stabilizer, an organic solvent and water shown in Table 16. The sol solution was applied at a pulling rate shown in Table 18 by a dip coating process to a magnet test piece having a surface cleaned by shot blasting and by degreasing using a solvent. And then, the magnet test piece was subjected to a heat treatment shown in Table 18 to form an Si—Zr composite oxide film on the surface of the magnet test piece.

The thickness of the formed Si—Zr composite oxide film ($SiO_x.ZrO_y$ film wherein $0<x\leqq 2$ and $0<y\leqq 2$) and the content of C in the film are shown in Table 19. The chemical shift of the 3d orbital of the Nd atom toward a high energy side determined by XPS is shown in Table 19. The XPS measurement was carried out in the same manner as in Examples 1 to 3.

The structure of the formed Si—Zr composite oxide film was analyzed by an X-ray diffraction method and as a result, the film was amorphous. The surface of the Si—Zr composite oxide film was observed (at a magnification of ×1,000) by an electron microscope and as a result, the film was dense with no pinhole therein.

TABLE 16

| | Metal compound | Catalyst | Stabilizer | Organic solvent |
|---|---|---|---|---|
| Example 9 | tetraethoxy silane and zirconium butoxide | Acetic acid | ethyl acetoacetate | ethanol + IPA |

IPA: isopropyl alcohol

TABLE 17

| | Proportion of metal compounds (wt % in terms of $SiO_2$ + $ZrO_2$) | Molar ratio Si/Si + Zr | Catalyst/M | Stabilizer/M | Water/M | Viscosity (cP) | pH |
|---|---|---|---|---|---|---|---|
| Example 9 | 5 | 0.34 | 2 | 1 | 1 | 1.9 | 3.9 |

M: Metal compounds (Si compound + Zr compound)

TABLE 18

| | Pulling rate (cm/min) | Heat treatment |
|---|---|---|
| Example 9 | 5 | 240° C. × 20 min |

TABLE 19

| | Thickness of film (μm) | Content of C in film (ppm) | Chemical shift of $Nd_{3d}$ (eV) |
|---|---|---|---|
| Example 9 | 0.7 | 350 | 0.9 |

The magnet having the Si—Zr composite oxide film formed thereon was subjected to a corrosion resistance acceleration test under the same conditions as in Examples 1 to 3. The results are shown in Table 20. In the magnet having the Si—Zr composite oxide film formed thereon, the film itself is dense with no pinhole therein. An interfacial layer with a Nd atom chemically bonded with a Si—Zr composite oxide film forming Si atom through an oxygen atom was formed between the film and the entire surface of the magnet and hence, the adhesion of the film to the surface of the magnet is excellent, and after the test, the film cannot be peeled off. Therefore, as apparent from Table 20, it was seen that both of the magnetic characteristic and the appearance had little deteriorated even under the above-described severe conditions, and a required corrosion resistance was achieved sufficiently.

TABLE 20

| | Before corrosion resistance test | | | After corrosion resistance test | | | |
|---|---|---|---|---|---|---|---|
| | Br(T) | HcJ(kA/m) | (BH)max ($kJ/m^3$) | Br(T) | HcJ(kA/m) | (BH)max ($kJ/m^3$) | Appearance after test |
| Example 9 | 1.14 | 1314 | 242 | 1.12 | 1306 | 234 | not varied |

Example 10

A sol solution was prepared at a composition, a viscosity and a pH value shown in Table 22 from a Zr compound, acatalyst, a stabilizer, an organic solvent and water shown in Table 21. The sol solution was applied at a pulling rate shown in Table 23 by a dip coating process to a magnet test piece having a surface cleaned by shot blasting and by degreasing using a solvent. And then, the magnet test piece was subjected to a heat treatment shown in Table 23 to form a Zr oxide film on the surface of the magnet test piece.

The thickness of the formed Zr oxide film ($ZrO_x$ film wherein $0<x\leqq 2$) and the content of C in the film are shown in Table 24.

The structure of the formed Zr oxide film was analyzed by an X-ray diffraction method from which it was found that the film was amorphous. The surface of the Zr oxide film was observed (at a magnification of ×1000) by an electron microscope from which it was found that the film was dense with no pinhole therein.

TABLE 21

| | Zr compound | Catalyst | Stabilizer | Organic solvent |
|---|---|---|---|---|
| Example 10 | zirconium isoPropoxide | acetic acid | ethyl acetoacetate | ethanol |

TABLE 22

| | Proportion of Zr compound | Molar ratio | | | | |
|---|---|---|---|---|---|---|
| | (wt % in terms $ZrO_2$) | Catalyst/ Zr compound | Stabilizer/ Zr compound | Water/ Zr compound | Viscosity (cP) | pH |
| Example 10 | 5 | 2 | 1.5 | 2 | 1.8 | 4.0 |

TABLE 23

| | Pulling rate (cm/min) | Heat treatment | Note |
|---|---|---|---|
| Example 10 | 5 | 240° C. × 10 min | (pulling → heat treatment) × 5 |

TABLE 24

| | Thickness of film (μm) | Content of C in film (ppm) |
|---|---|---|
| Example 10 | 0.8 | 380 |

The magnet having the Zr oxide film formed thereon was immersed in a 1 mol/l of an aqueous solution of NaOH at a temperature of 65° C. for 2 hours and then washed with water and dried. Thereafter, the magnet was subjected to a corrosion resistance acceleration test under the same conditions as in the examples 1 to 3. The results are shown in Table 25. As apparent from Table 25, in the magnet having the Zr oxide film formed thereon, the film itself is dense with no pinhole therein. The adhesion of the film to the surface of the magnet is excellent, and after the test, the film cannot be peeled off. Therefore, it was seen that the magnetic characteristic and the appearance of the magnet having the Zr oxide film formed thereon had little deteriorated, even if the magnet was immersed in the aqueous alkali solution and then left to stand under the severe conditions, and a required corrosion resistance and a required alkali resistance were achieved sufficiently.

TABLE 25

| | Before corrosion resistance test | | | After corrosion resistance test | | | |
|---|---|---|---|---|---|---|---|
| | Br(T) | HcJ(kA/m) | (BH)max ($kJ/m^3$) | Br(T) | HcJ(kA/m) | (BH)max ($kJ/m^3$) | Appearance after test |
| Example 10 | 1.15 | 1305 | 243 | 1.13 | 1297 | 236 | not varied |

What is claimed is:

1. A rare earth metal-based permanent magnet having a metal oxide film formed on the surface thereof by a sol-gel coating process, wherein said metal oxide film contains carbon.

2. A rare earth metal-based permanent magnet according to claim 1, wherein said rare earth metal-based permanent magnet is an R—Fe—B based permanent magnet.

3. A rare earth metal-based permanent magnet according to claim 1, wherein said rare earth metal-based permanent magnet is an R—Fe—N based permanent magnet.

4. A rare earth metal-based permanent magnet according to claim 1, wherein said metal oxide film is formed from a metal oxide component including at least one member from the group consisting of Al, Si, Ti and Zr oxides.

5. A rare earth metal-based permanent magnet according to claim 1, wherein said metal oxide film is amorphous.

6. A rare earth metal-based permanent magnet according to claim 1, wherein the content of carbon is in a range of 50 ppm to 1,000 ppm (wt/wt).

7. A rare earth metal-based permanent magnet according to claim 1, wherein the thickness of said metal oxide film is in a range of 0.01 $\mu$m to 5 $\mu$m.

8. A rare earth metal-based permanent magnet having a metal oxide film, wherein said magnet has, between said metal oxide film and the entire surface of said magnet, an interfacial layer with an R (rare earth element) atom chemically bonded with a film forming metal atom through an oxygen atom, and said metal oxide film contains carbon.

9. A rare earth metal-based permanent magnet according to claim 8, wherein said metal oxide film is formed from a metal oxide component including at least one member selected from the group consisting of Al, Si and Ti oxides.

10. A rare earth metal-based permanent magnet according to claim 8, wherein said interfacial layer is formed by forming the metal oxide film on the surface of the magnet by a sol-gel coating process.

* * * * *